US006536968B2

(12) United States Patent
Lee et al.

(10) Patent No.: US 6,536,968 B2
(45) Date of Patent: Mar. 25, 2003

(54) PAPER TRAY FOR A PRINTER

(75) Inventors: Hock Lim Lee, Singapore (SG); Kong Hock Lim, Singapore (SG)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/728,686

(22) Filed: Dec. 1, 2000

(65) Prior Publication Data

US 2002/0067944 A1 Jun. 6, 2002

(51) Int. Cl.[7] ..... B41J 11/58; B65H 5/00; B65H 3/68; G01D 11/00; G03G 15/00

(52) U.S. Cl. ..... 400/624; 400/625; 400/708; 271/264; 271/101; 347/100; 399/393

(58) Field of Search ..... 400/625, 708, 400/624; 271/264, 101; 399/393; 347/100

(56) References Cited

U.S. PATENT DOCUMENTS 5,746,528 A * 5/1998 Mayer et al. ..... 400/625
5,803,631 A * 9/1998 Bingham et al. ..... 400/624
6,206,367 B1 * 3/2001 Jo ..... 271/264
6,267,522 B1 * 7/2001 Slippy et al. ..... 400/708
6,322,264 B1 * 11/2001 Osmus et al. ..... 400/624
6,338,585 B1 * 1/2002 Amano ..... 400/624

* cited by examiner

*Primary Examiner*—Andrew H. Hirshfeld
*Assistant Examiner*—Marvin P. Crenshaw

(57) ABSTRACT

A tray for holding a stack of sheets of paper for feeding into a printer includes opposite paper guides one of which is adjustable relative to the other for varying the spacing between the paper guides. The adjustable paper guide is slideable across the tray and includes a releasable lock which engages the tray for locking the paper guide in position. The releasable lock is preferably a spring biased lever which includes a tooth that normally engages a rack in the paper tray until released by operation of the lever for the paper guide to be adjusted. As the paper guide is locked in position it cannot move away from its location during feeding of papers from the tray. The paper guide may also include a spring arm for applying a bias against the edge of the sheets of paper as they are fed from the tray to prevent them from skewing.

9 Claims, 4 Drawing Sheets

PAPER TRAY FOR A PRINTER

FIELD OF THE INVENTION

This invention relates to a tray for holding a stack of sheets of paper or other print media for feeding into a printer, For convenience, the term "paper" throughout this specification is to be understood as encompassing all forms of print media including paper, plastic transparency sheets, vellum, and the like which are storable in a tray for feeding into a printer.

BACKGROUND

Paper trays associated with printers and having relatively adjustable side members, which act as paper guides, for accommodating different paper widths are known. At least one such paper guide is usually slidably mounted on the tray for movement towards or away from the other to vary their spacing, the slidable mounting being such that the paper guide is "stiffly" movable across the tray so that it will remain in position against the side edge of a stack of papers. That is, there needs to be a relatively high degree of frictional resistance to movement of the paper guide once positioned against a stack for it to function properly as a guide. However if this frictional resistance is too high, it becomes very difficult to adjust the paper guide on the tray, particularly given that very small width adjustments may have to be made. Thus a balance has to be struck between a user friendly ease of adjustment criterion and an opposing operational requirement. Unfortunately this balance is often such that the adjustable paper guide very gradually gets pushed away from the side edge of the stack of papers during the printing of numerous sheets. This is due to a side thrust force generated by a paper sheet as it enters into the feed trough of a printer prior to printing. Eventually a sufficient gap may develop between the side edge of the paper stack and the paper guide as to not prevent skewing of paper sheets as they are fed into the printer.

SUMMARY OF THE INVENTION

An object of the present invention is to provide a paper tray having an adjustable paper guide which cannot move away from a selected adjustment position on the tray and yet is readily adjustable between selected adjustment positions.

According to the present invention there is provided a tray for holding a stack of sheets of paper for feeding into a printer, the tray including a bottom support and two side paper guides at least one of which is adjustable relative to the other to vary a spacing between the two paper guides for accommodating different paper widths, the at least one adjustable paper guide being slidably mounted on the tray and having releasable means normally engaging said bottom support for locking said at least one paper guide in selectable positions thereon.

Thus the invention provides for a paper guide to be locked to the tray at a selected adjustment position. This is achieved by a means on the paper guide which in its normal position engages a surface of a bottom support of the tray. This means is releasable and when so released and held in its released position, the paper guide is readily slidable across the tray for movement to another selected position, whereat the releasable means is released for it to again engage and thus lock the paper guide in position.

Preferably the releasable means includes a detent or protrusion for engaging within a complementary means, such as one of a number of spaced indentations or recesses in the bottom support of the tray. The detent or protrusion may be a tooth for engaging a rack which is toothed thereby providing the spaced indentations. This rack may comprise closely spaced teeth such that with a complementary sized tooth and the releasable locking means, the paper guide can be adjusted by a very small amount. Preferably the releasable means includes a member mounted on the paper guide which has the protrusion or tooth depending therefrom. This member is preferably resiliently biased relative to the paper guide such that the protrusion or tooth normally engages one of the indentations in the bottom support surface of the tray and which may be provided by the above described rack. Preferably this member is pivotally mounted on the paper guide and acts as a lever whereby an upper portion thereof is manually pivotal towards the paper guide against a resilient bias to disengage the protrusion or tooth from an indentation in the rack in the bottom support surface of the tray. Thus an operator is enabled with one hand to release the locking means and hold it in a released position whilst sliding the paper guide to another selected position to make an adjustment to accommodate a different paper width in the tray. When the locking means is released, it automatically re-engages the complementary means of the bottom support surface of the paper tray to again lock the paper guide in position.

Preferably the adjustable paper guide further includes a resilient bearing member which is positioned thereon such that it engages a side edge of a stack of paper sheets within the tray to substantially prevent a sheet from skewing as it feeds into a printer from the paper stack.

DETAILED DESCRIPTION OF PREFERRED EMBODIMENT

Figure 1:
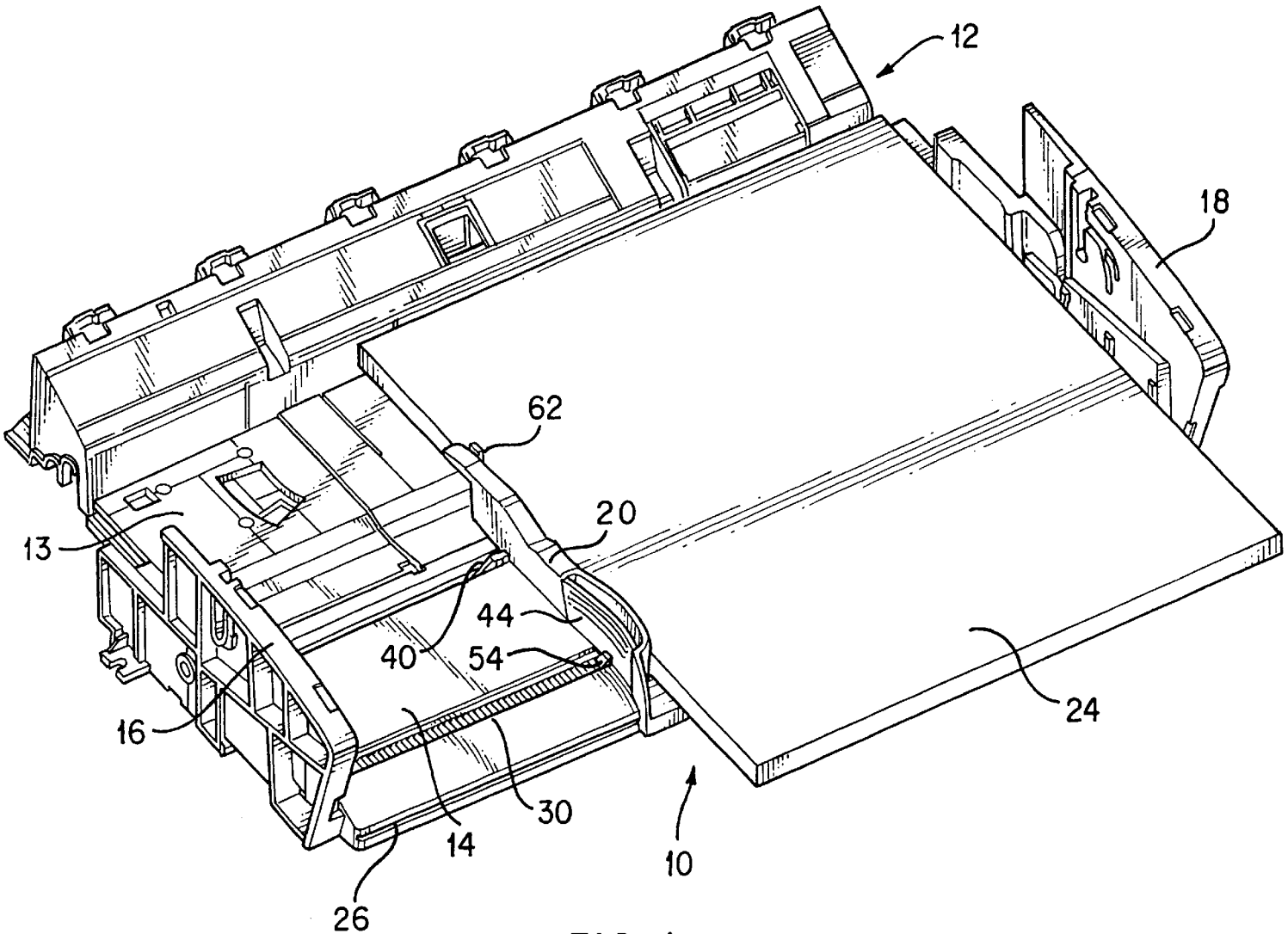
FIG. 1 is a perspective view of an embodiment of a tray according to the invention.

With reference to FIG. 1, paper tray 10 is positioned adjacent to the paper feeding means 12 of a printer (not shown). The paper tray 10 has a main tray 13 onto which a bottom support 14 can be snap-fitted. Main tray 13 includes fixed side members 16, 18, one of which 18 is a paper guide. Another paper guide 20 is positioned between side members 16 and 18 and is slidable across the bottom support 14. The region bound by slidable paper guide 20 and side member 18 defines an area for receiving a stack of sheets of paper 24 which is supported on the surface of bottom support 14 and maintained in position by slidable paper guide 20.

Figure 2:
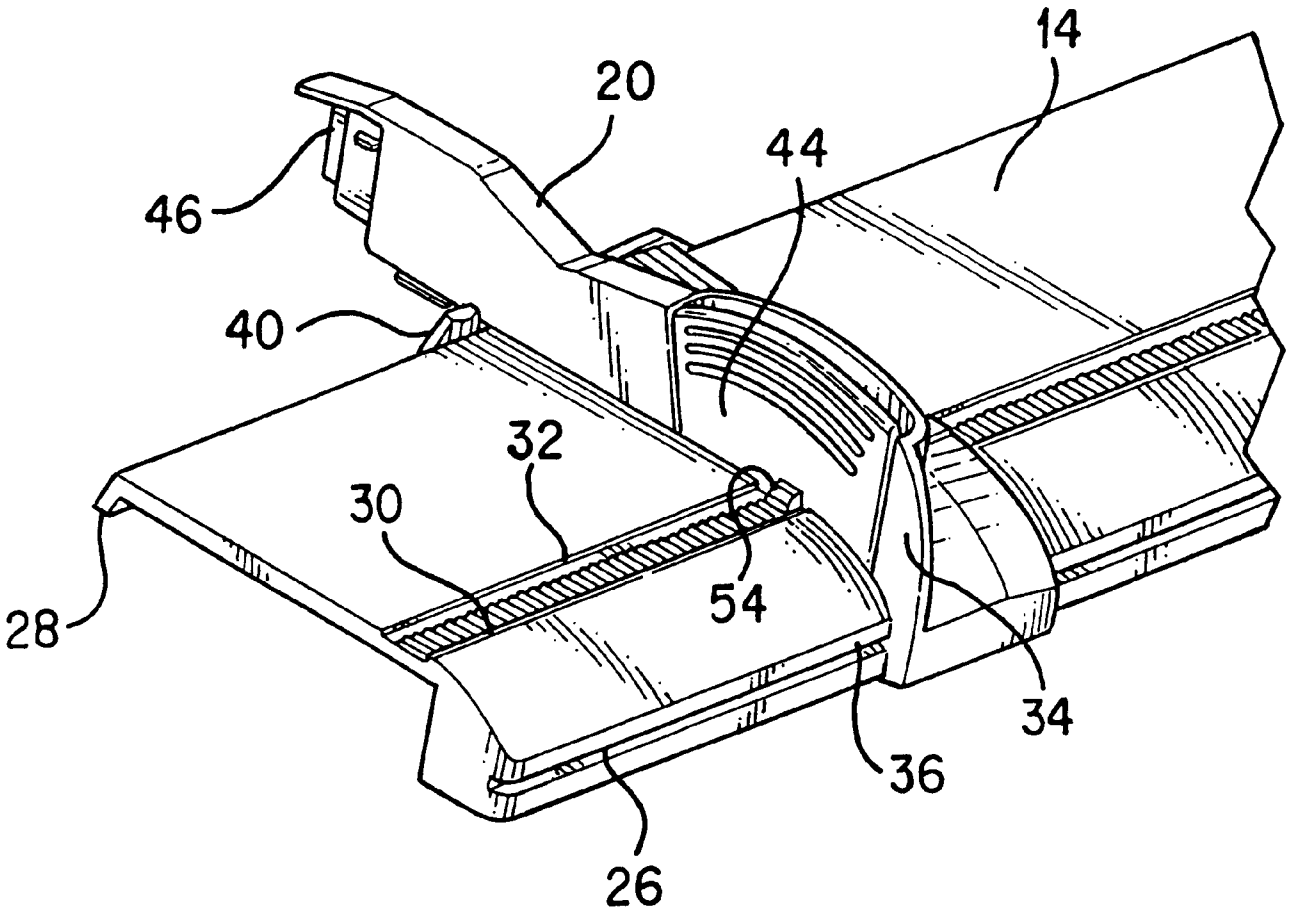
FIG. 2 is a perspective view of portion of the tray of FIG. 1, illustrating the mounting of a slideable paper guide thereon.

With reference to FIG. 2, the bottom support 14 of tray 10 includes continuous groove 26 and ledge 28 which extend across the width of bottom support 14. This groove and ledge are for slidably mounting the adjustable paper guide 20 on the tray 10 as described in detail below. A rack 30 also extends across the width of bottom support 14 which provides a series of regularly and closely spaced apart indentations 32.

Figure 3:
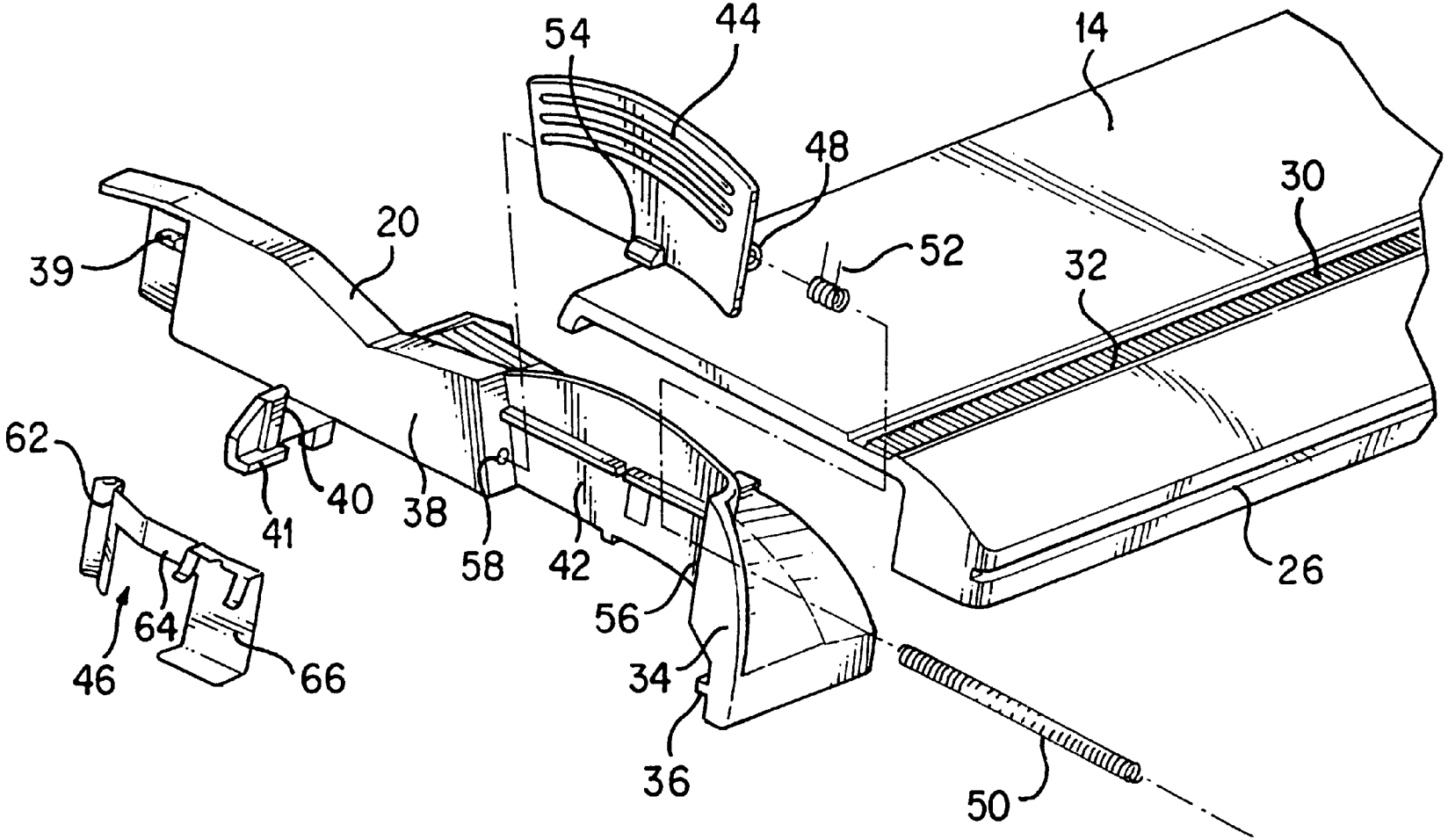
FIG. 3 is an exploded perspective view of the components of the slideable paper guide of FIG. 2.

With reference to FIG. 3, the slidable paper guide 20 includes an end portion 34 having a depending portion that includes a rib 36 which is received within groove 26. A forward portion 38 of the slidable paper guide 20 includes a depending formation 40 having a flange 41 which seats under ledge 28. Thus slidable paper guide 20 is mounted on tray 10 via sliding engagement of rib 36 in groove 26 and sliding contact between flange 41 and ledge 28. Rib 36 and groove 26, and formation 40 and ledge 28 are respectively shaped such that paper guide 20 can slide continuously across the bottom support 14 without being separable therefrom except at the sides of bottom support 14 upon its removal from main tray 13. Paper guide 20 contains a cavity 42 for accommodating a releasable means in the form of a lever member 44. The forward end of portion 38 of paper guide 20 includes an extension 39 for snap-mounting a resilient bearing member 46 such as a bias spring, the function of which is described below.

Lever member 44 fits within cavity 42. It includes a structure 48 having a through hole for a pivot pin 50 which is mounted between the end portion 34 and forward portion 38 of paper guide 20. A biasing means in the form of a coil spring 52 is mounted on pin 50 and acts between paper guide 20 and lever member 44 to bias the upper portion of the lever member 44 away from the paper guide. The lever member 44 includes a depending protrusion 54, which is a tooth for engaging a depression 32 of rack 30. The bias on lever 44 provided by spring 52 maintains tooth 54 normally in engagement in a depression 32 of rack 30, thereby locking the paper guide 20 in a selected position an the bottom support 14 of tray 10. Releasable member 44 is assembled on paper guide 20 by placing it within cavity 42 and press fitting pin 50 through a first hole 56 in end portion 34 of paper guide 20, through the spring 52, then through the through hole of structure 48 of lever member 44, and then press-fitting it into a second hole 58 in the forward portion 38 of paper guide 20, which provides a side wall of cavity 42. Bias spring 46 can then be snap-fitted to the extension 39 at the paper feeding end of paper guide 20. Paper guide 20 is then slidably mounted on bottom support 14 from a side thereof by sliding rib 36 within groove 26 and flange 41 under ledge 28 (see FIG. 2). Once paper guide 20 has been mounted on bottom support 14, the bottom support is then attached to main tray 13.

In operation, a stack of papers 24 is placed on bottom support 14 against side member 18 and slidable paper guide 20 is moved until its inner facing side contacts the other side edge of the stack of papers 60.

Figure 4:
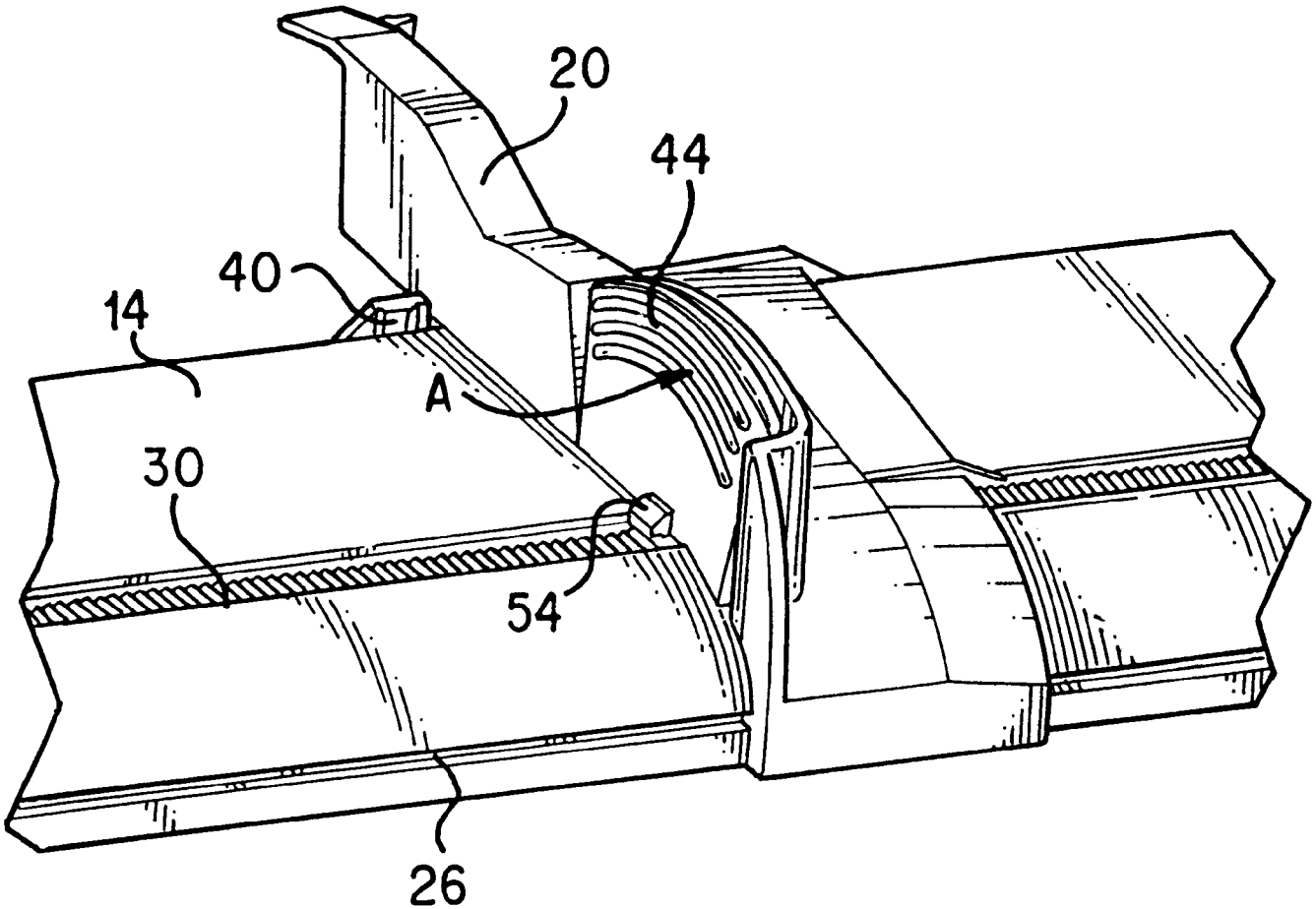
FIG. 4 is a perspective view of portion of the tray of FIG. 1 illustrating operation of the slideable paper guide.

The bias on lever member 44 provided by spring 52 maintains its tooth 54 normally in engagement with rack 30. To release the paper guide 20, the upper portion of lever member 44 and the paper guide can be manually gripped between the thumb and a finger of one hand to pivot the upper portion of lever member 44 towards the paper guide about pin 54 (see arrow A on FIG. 4), which moves tooth 54 out of engagement with rack 30. Whilst thus holding the tooth 54 disengaged, the paper guide 20 is moved across the bottom support 14 to a different position whereat the lever member 44 can be released such that spring 52 acts to pivot it for its tooth 54 to again engage the rack 30.

The resilient bearing member 46, includes a forward portion 62 (see FIG. 3) which provides a surface for bearing against the side edge of paper stack 24. This forward portion 62 is connected by spring arm 64 to a rear portion 66 which is for snap-fitting the bias spring onto extension 39 of paper guide 20. Bias spring 46 is positioned on paper guide 20 at its forward end and acts to maintain a bias on the side edge of the stack of paper 24 and functions to substantially prevent skewing of a paper sheet as it feeds therefrom into the printer.

What is claimed is:

1. A tray for holding a stack of sheets of paper for feeding into a printer, the tray including a bottom support and two side paper guides at least one of which is adjustable relative to the other to vary a spacing between the two paper guides for accommodating different paper widths, wherein the at least one adjustable paper guide is slidably mounted on the tray, and wherein a releasable means including a tooth is mounted on the adjustable paper guide, the bottom support including a toothed rack, whereby the tooth normally engages within the toothed rack to lock said at least one paper guide in selectable positions thereon, wherein the at least one adjustable paper guide includes a lever which is pivotally mounted on the paper guide and which provides the tooth, and the lever is resiliently biased relative to the paper guide for the tooth to normally engage within the toothed rack of the bottom support.

2. A tray as claimed in claim 1 wherein the lever is pivotal about an axis which is substantially parallel with the adjustable paper guide and includes an upper portion which is manually movable towards said adjustable paper guide against said resilient bias to disengage the protrusion from a spaced indentation, whereby said adjustable paper guide is slidable across the bottom support to vary said spacing between the two paper guides.

3. A tray as claimed in claim 1 wherein the at least one adjustable paper guide includes a resilient bearing member for engaging a side edge of a stack of sheets within the tray, wherein the resilient bearing member is located such that it substantially prevents a sheet from skewing as it feeds into a printer from said stack.

4. A tray as claimed in claim 3 wherein the resilient bearing member includes a portion which extends from the adjustable paper guide in a paper feeding direction, wherein said portion comprises a spring arm.

5. A tray as claimed in claim 4 wherein the spring arm has a paper bearing surface formed adjacent its end which is remote from the adjustable paper guide.

6. A tray as claimed in claim 5 wherein the resilient bearing member includes a formation for snap fitting it onto the at least one adjustable paper guide.

7. A paper tray for a printer comprising a bottom support for supporting a stack of paper sheets, a first paper guide at a side of the bottom support against which a side edge of said stack of paper sheets is locatable, a second paper guide mounted on the bottom support such that it is slidable towards and away from the first paper guide, a lever pivotally mounted on the paper guide and having a locking portion, the bottom support including a rack formed therein with which the locking portion of the lever is engageable, a bias spring acting between the second paper guide and the lever for maintaining the locking portion in engagement with the rack whereby the second paper guide is locked to the bottom support, wherein the lever is moveable relative to the second paper guide against the bias spring to disengage the locking portion from the rack for the second paper guide to be moved towards or away from the first paper guide.

8. A paper tray as claimed in claim 7 wherein the rack defines closely spaced indentations which are engageable by the locking portion of the lever, whereby the second paper guide is adjustable relative to the first paper guide in small increments.

9. A paper tray as claimed in claim 7 wherein the lever is located relative to the second paper guide such that it is operable and the paper guide is thus slideable by an operator using a single hand.

* * * * *